US006900583B2

(12) United States Patent
Testa et al.

(10) Patent No.: US 6,900,583 B2
(45) Date of Patent: May 31, 2005

(54) VIBRATION ABSORBER DEVICE FOR COLOR CATHODE-RAY TUBE

(75) Inventors: Pierluigi Testa, Rome (IT); Enzo Arata, Colleferro (IT); Ivano Domenicali, Gavignano (IT)

(73) Assignee: Thomson Licensing S. A., Boulogne-Billancourt (FR)

( * ) Notice: Subject to any disclaimer, the term of this patent is extended or adjusted under 35 U.S.C. 154(b) by 0 days.

(21) Appl. No.: 10/454,968

(22) Filed: Jun. 4, 2003

(65) Prior Publication Data

US 2003/0227242 A1 Dec. 11, 2003

(30) Foreign Application Priority Data

Jun. 7, 2002 (IT) ..... MI2002A1251

(51) Int. Cl.[7] ..... H01J 1/18; H01J 19/12
(52) U.S. Cl. ..... 313/404; 313/407; 313/269
(58) Field of Search ..... 313/269, 402, 313/404, 407, 408, 50; 248/636, 638, 560; 181/207–209

(56) References Cited

U.S. PATENT DOCUMENTS

| | | | | |
|---|---|---|---|---|
| 4,506,188 A | * | 3/1985 | Puhak | 313/405 |
| 4,827,179 A | | 5/1989 | Adler et al. | 313/402 |
| 6,469,429 B1 | | 10/2002 | Berton | 313/402 |
| 6,469,431 B1 | | 10/2002 | Suzuki et al. | 313/407 |
| 6,489,714 B2 | | 12/2002 | Kim | 313/407 |
| 6,573,647 B2 | * | 6/2003 | Suzuki et al. | 313/407 |
| 6,614,155 B2 | * | 9/2003 | Michalchuk | 313/407 |
| 2001/0002352 A1 | * | 5/2001 | Mizuta et al. | 445/35 |
| 2002/0036457 A1 | * | 3/2002 | Kim et al. | 313/407 |

FOREIGN PATENT DOCUMENTS

| | | | |
|---|---|---|---|
| JP | 11-250826 | 9/1999 | H01J/29/07 |
| JP | 2001-196000 | 7/2001 | H01J/29/07 |
| JP | 2002-110058 | 4/2002 | H01J/29/07 |
| WO | WO 00/33348 | 6/2000 | H01J/29/07 |

* cited by examiner

*Primary Examiner*—Ashok Patel
(74) *Attorney, Agent, or Firm*—Joseph S. Tripoli; Harvey D. Fried; Patricia A. Verlangieri

(57) ABSTRACT

Color cathode-ray tube comprising a color selection mask (8) placed on a metal frame (19), the said frame comprising, on at least two opposite sides, means of damping vibrations of the mask, of the type comprising two masses (51) connected to the surface of the frame by a connection having a mechanical clearance between the facing surfaces of the mask and of the frame.

8 Claims, 4 Drawing Sheets

VIBRATION ABSORBER DEVICE FOR COLOR CATHODE-RAY TUBE

The present invention relates to a masking device for a colour cathode-ray tube. The invention is applicable to any type of tube having a colour selection mask and is equally well suited to tubes whose mask is held under tension by the frame to which it is secured, as to masks formed by pressing then fastened by welding to the support frame.

BACKGROUND OF THE INVENTION

Conventional cathode-ray tubes have a colour selection mask located at a precise distance from the inside of the glass front face of the tube, on which front face red, green and blue phosphor arrays are deposited in order to form a screen. The mask consists of a metal sheet perforated in its central part with a plurality of holes or slots. An electron gun, placed inside the tube, in its rear part, generates three electron beams in the direction of the front face. An electromagnetic deflection device, generally placed outside the tube and close to the electron gun, has the function of deflecting the electron beams so as to make them scan the surface of the screen on which the phosphor arrays are placed. Under the influence of the electron beams, each one corresponding to a particular primary colour, the phosphor arrays enable images to be reproduced on the screen, the mask allowing each particular beam to illuminate only the phosphors of the corresponding colour.

The colour selection mask must be placed and held during operation of the tube in an exact position inside the tube. The function of holding the mask is achieved by virtue of a rectangular metal frame, which is usually very rigid, to which the mask is conventionally welded. The frame/mask assembly is mounted inside the front face of the tube by virtue of suspension means usually welded to the frame and cooperating with tabs inserted in the glass forming the front face of the tube.

The current trend is for tubes whose front face is increasingly flat, with a tendency towards completely flat faces. The production of tubes having such a front face involves a technology consisting in using a flat mask, held under tension in at least one direction. Such structures are described, for example, in U.S. Pat. No. 4,827,179.

More conventionally, the mask may be formed by pressing, its surface perforated with openings then being slightly curved in order to follow the inner curvature of the glass front face of the tube. The peripheral skirt of the mask, formed so as to be perpendicular to the surface perforated with openings, is conventionally welded to the edge of the support frame.

Since the colour selection mask consists of a very thin metal sheet, placing it under tension may generate interference in the form of vibration of the said mask during operation of the tube. Under the effect of external impacts or mechanical vibration, for example acoustic vibration due to the loudspeakers of the television set in which the tube is inserted, the mask may start vibrating at its natural resonant frequency. The vibration of the mask changes the region where the electron beams land on the screen of the tube, the point of impact of each beam then being offset with respect to the associated phosphor array, thus creating discolouration of the image reproduced on the screen.

The phenomenon may also occur for a mask formed by pressing, since its virtually flat surface does not have enough mechanical rigidity to be insensitive to the vibration phenomena generated by the tube environment.

U.S. Pat. No. 4,827,179 proposes adding means for damping the vibration of the mask onto one face of the mask. These means are, in the known manner, placed on the peripheral part of the mask not perforated with openings. However, the damping devices used in this patent have a complicated structure which is difficult to implement. These devices must be fitted to the surface of the mask once the latter is secured to the frame, since the fragility of the thin metal sheet perforated with openings forming the mask does not make it possible to fit additional components thereto before it is fitted on the frame. However, here again, the fragility of the mask may pose a problem for welding damping means on its surface: any final alteration to the surface of the mask may cause rejection of the complete masking device. Moreover, when welding damping elements to the edges of the mask, welding sputter may occur and close off the holes on the central surface of the mask, which would also cause the whole masking device to be rejected.

It is an object of the said invention to provide a cathode-ray tube comprising a masking device for a colour cathode-ray tube comprising simple, inexpensive damping means which are easy to fit without leading to deterioration of the mask surface and equally suitable for the tensioned mask structure as for a mask structure formed by pressing.

To do this, the cathode-ray tube according to the invention comprises:

- a colour selection mask in the form of a metal sheet, adapted in order to be fastened to a substantially rectangular support frame and comprising one pair of short parallel sides and one pair of long parallel sides, the frame/mask assembly being placed inside the glass front face of the tube,
- means of damping vibrations of the frame/mask assembly, placed on each side of at least one pair of parallel sides of the frame, the said damping means being characterized in that they comprise at least one mass connected to the side of the frame by a connection having a mechanical clearance between the facing surfaces of the mass and of the frame.

BRIEF DESCRIPTION OF THE DRAWINGS

The invention will be better understood with the help of the description below and the drawings, among which.

DETAILED DESCRIPTION OF THE PREFERRED EMBODIMENT

Figure 1:
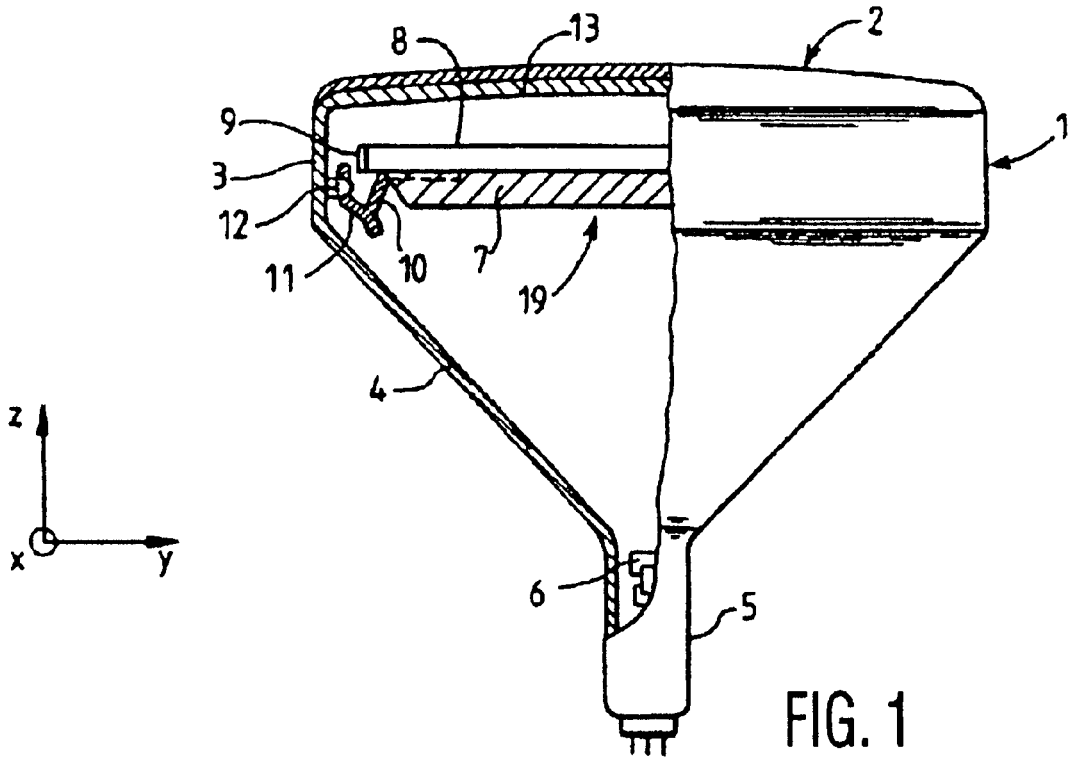
FIG. 1 shows a cathode-ray tube according to the invention seen partially exploded.

As illustrated in FIG. 1, a cathode-ray tube 1 according to the invention comprises a substantially flat tile 2 and a peripheral skirt 3. The tile is connected to the rear part of the tube, in the shape of a funnel 4, by virtue of a glass frit seal. The end part of the tube 5 surrounds the electron gun 6, the beams of which illuminate the luminescent phosphor screen 13 through the colour selection mask 8, which in this case is flat, for example tensioned between the long sides 9 of the frame 19. Metal supports for the frame/mask assembly hold this assembly inside the tube, it being possible for the said supports to comprise one part 10 welded to the frame and one part forming a spring 11, provided with an opening in order to engage with a tab 12 included in the glass skirt 3.

Figure 2:
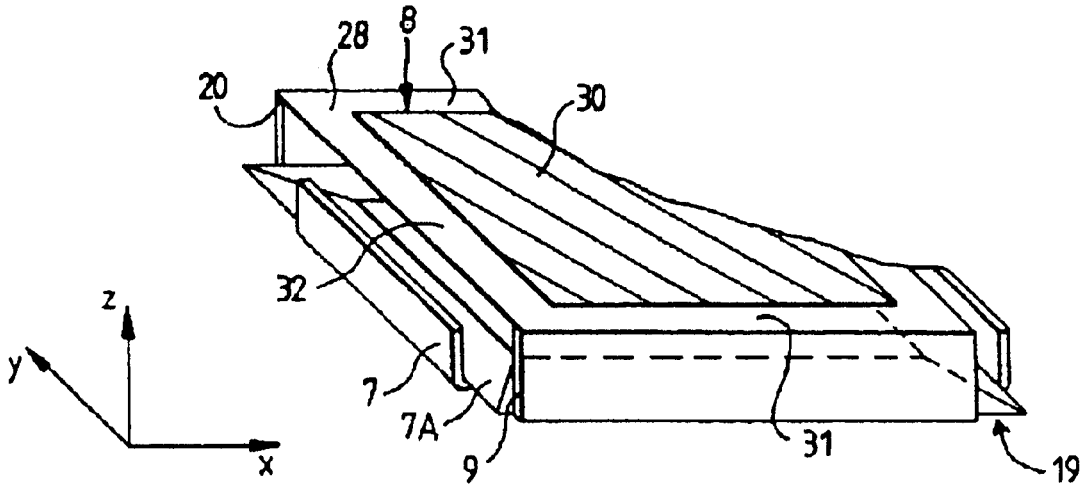
FIG. 2 PRIOR ART
FIG. 2 describes a frame/mask assembly tensioned according to the prior art without a vibration damper.

In the example of the prior art illustrated in FIG. 2, the frame 19 comprises a pair of long sides 9 and a pair of short sides 7, the said long and short sides having, for example, an L-shaped cross section, the short sides 7 having a flange 7A substantially parallel to the mask. The mask 8, itself of substantially rectangular shape, is tensioned, then held in this state for example by welding the said long sides of the frame to the end 20.

The mask 8 consists of a metal sheet, for example made of steel or of invar, with a very small thickness, of about 100 μm. The mask has a central region 30 perforated with openings generally-arranged in columns and a peripheral region 28 surrounding the central region 30, the peripheral region comprising, for example, horizontal 31 and vertical 32 edges which do not participate in the selection of colours.

The structures of cathode-ray tubes using tensioned colour selection masks have to face the problem of vibration of this mask, according to modes which are natural to it, when the said mask is excited by external vibrations, for example mechanical impacts on the tube or sound vibrations coming from loudspeakers placed close to the tube. Since these vibrations appear as movements of the mask in a direction perpendicular to its surface, the distance between the openings of the mask and the screen vary locally according to the amplitude of the vibration of the said mask. The purity of the colours reproduced on the screen is then no longer guaranteed, the landing points of the beams on the screen being offset according to the amplitude of the vibration and to the region of the mask set in vibration; for example, vibrations of the edges of the apertured part 30 of the mask will be more visible on the screen since this region is traversed by electron beams at high angles of incidence.

Moreover, since the mask is placed inside the tube in which there is a medium vacuum, the mask vibrations are damped only very slowly, the energy communicated to the mask having little means of dissipation, which increases the visibility of the phenomenon on the screen when the tube is in operation.

The same phenomenon may occur with masks formed by pressing then welded to the frame, particularly for tubes having a substantially flat front face. Since the surface of the mask participating in the selection of colours closely follows the inner surface of the front face of the tube, the flatness of the mask surface means this surface has very little mechanical rigidity and on the contrary, is sensitive to vibrations from the environment.

Figure 4:
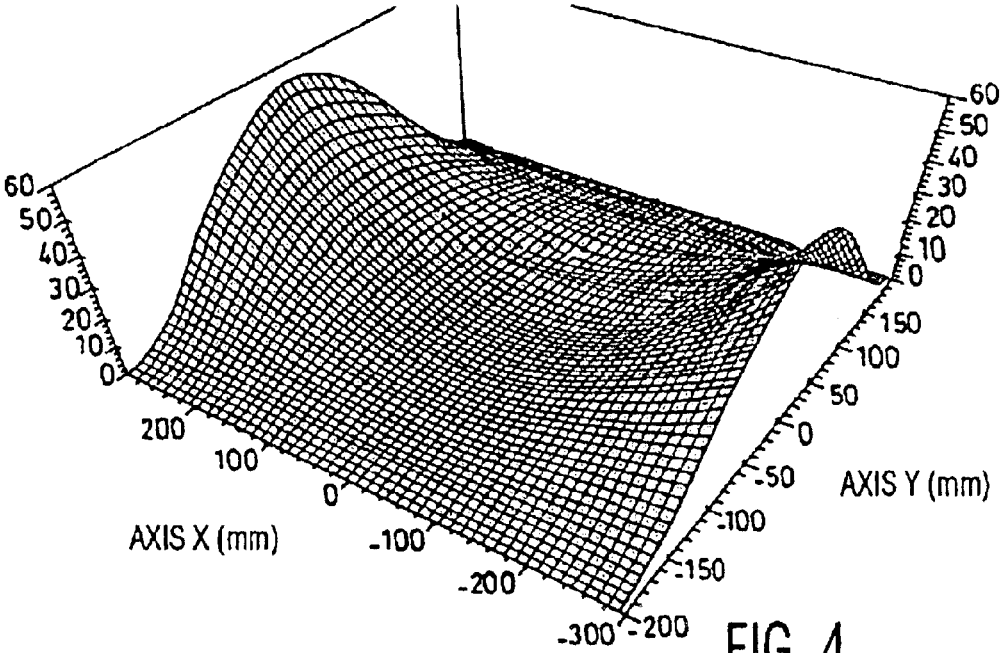
FIG. 4 illustrates the displacement profile of the surface of a tensioned mask subject to vibration.

When the frame/mask device is such that the mask has an apertured part 30 with openings in columns connected together by metal bridges, and that the tension exerted on the mask is uniaxial, for example in the direction of the short side 32, the long sides being welded to the edges 20 of the long sides 9 of the frame, the behaviour of the mask when vibrating is as shown in FIG. 4; the amplitude of vibration of the mask is maximal in: the middle of the short sides 32 and it is therefore advantageous to place a vibration damper in this region so as to damp as much as possible the vibrations of the vertical edges of the mask.

Figure 3:
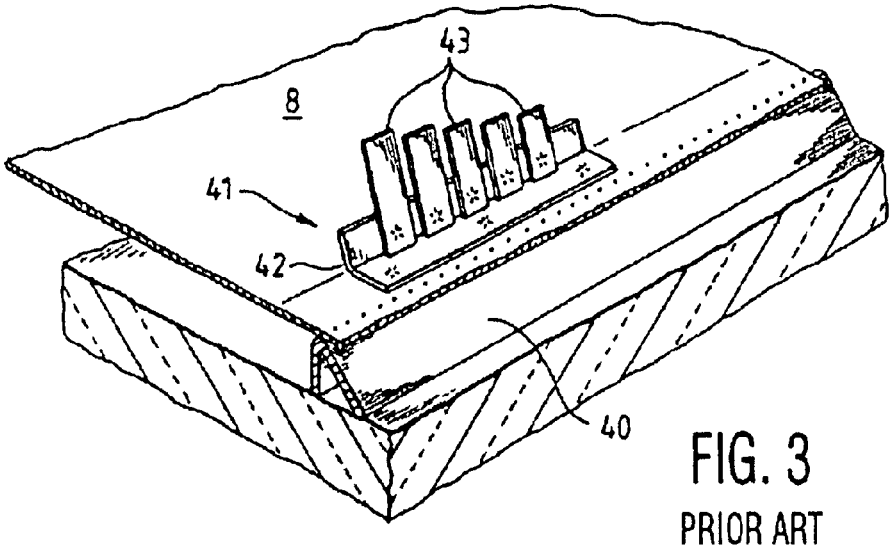
FIG. 3 PRIOR ART
FIG. 3 is a perspective view of one embodiment of a device for damping vibration according to the prior art.

As illustrated in FIG. 3, U.S. Pat. No. 4,827,179 proposes a solution for damping the vibrations of the mask with a device 41 forming a coupled oscillator, by placing on the edges of the mask 8, close to the region where the mask is welded to the frame 40, a mechanical structure comprising a rigid support 42, to which is welded at least one flexible blade 43. The natural resonant frequency of the device 41 is chosen so as to damp the vibrations of the mask within a particular frequency band. However, this structure has a certain number of disadvantages:

- it is complex and expensive because of the large number of metal parts used (support and flexible blades);
- energy dissipating elements must be added to the damping structure if it is desired that the vibrations of the mask be damped quickly;
- it is welded to the mask which itself is mechanically fragile;
- welding it to the mask may generate sputter which can close the orifices of the mask.

The invention provides a simple, economic structure which is easy to implement in order to damp the mask vibrations generated by the tube's environment.

Figure 5:
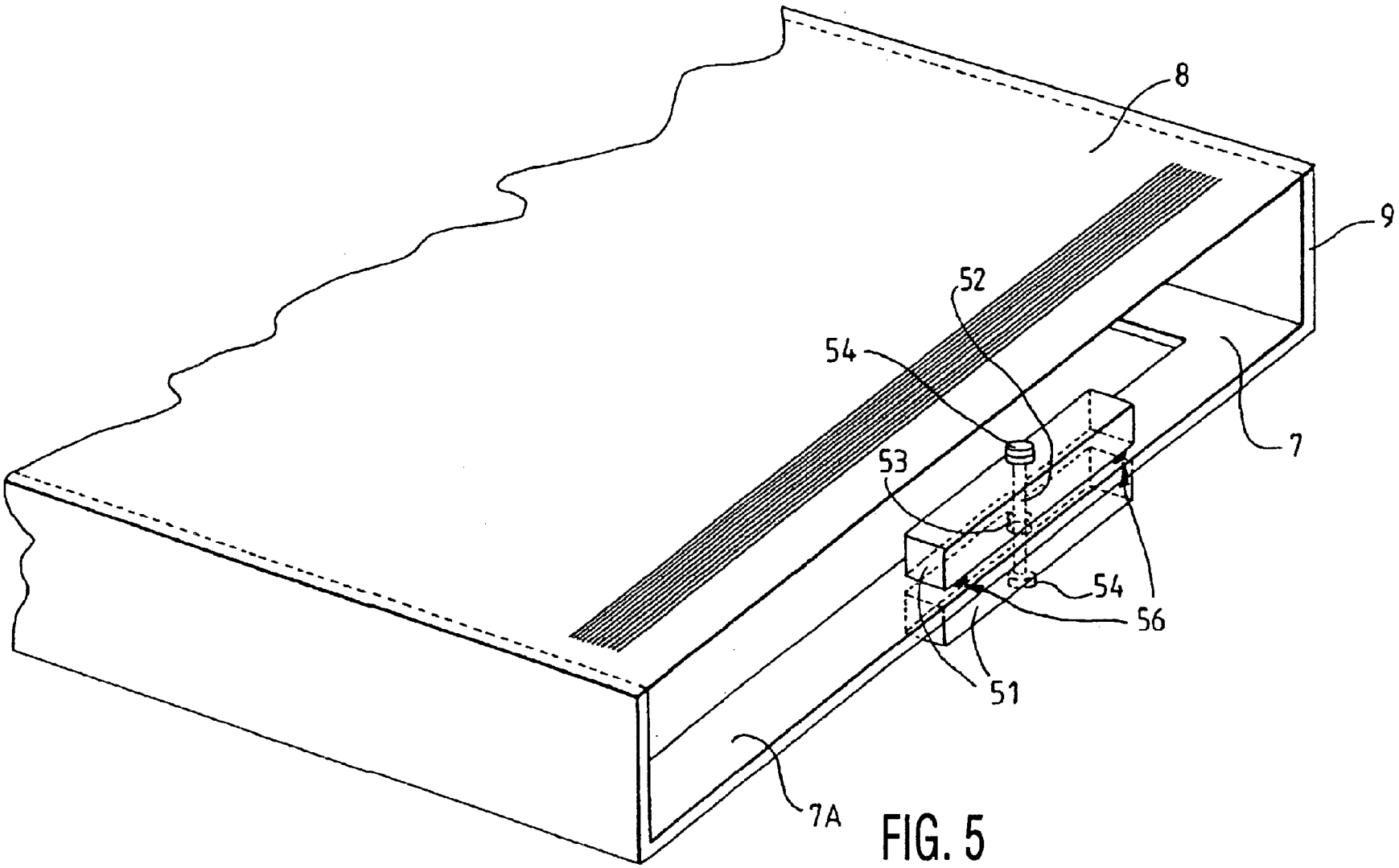
FIGS. 5 and 6 illustrate different embodiments of the invention.

FIG. 5 is a perspective view of a first embodiment of the invention, suitable for a mask tensioned in a single direction, for example parallel to its short sides 32.

Along the short sides 7 of the frame, on the flange 7A located facing the mask, there is a damping device in the form of two substantially parallelepipedal masses 51 placed on each side of the flange 7A; a cylindrical metal pin 52, placed perpendicular to the flange 7A, passes through the two masses by means of a channel and the said flange 7A by means of an orifice 53 such that the pin can pass freely through the channels and the orifice 53. At the ends of the pin 52, heads 54 hold the masses 51 on the short sides 7 of the frame by virtue of their size which is larger than the diameter of the channel in which the said pin 52 is inserted. In this way, the masses are fastened to the frame by a mechanical connection having a certain clearance which can be predetermined by the length of the pin 52 with respect to the dimensions of the masses 51. Thus the facing surfaces of the masses 51 and of the flange 7A may move independently of each other with a maximum distance corresponding to the desired clearance which is at the most about a few millimetres for medium-sized tubes.

In an alternative embodiment, the pin 52 and the inner surface of the channels of the masses 51 are threaded so that the said pin can be screwed into the said channels; the pin is then secured to the masses and it is the masses/pin assembly which is moved with respect to the frame, the pin 52 sliding through the side of the frame via the orifice 53.

Given that the movements of the short sides of the frame are maximal in the middle and that the total kinetic energy of the elementary masses $m_i$ forming the said sides can then be written, for each side:

$$\sum \frac{1}{2} m_i v_i$$

and moreover, given that on each vibration, one of the two masses 51 will alternately oppose the movement of the frame, the result is that the ideal weight of each mass is about half the weight of the short side of the frame.

Experience shows that damping of vibrations becomes effective when the masses 51 have a total weight at least equal to 60% of the weight of the side of the frame to which they are fastened, that is 30% of the weight of the said side for each embodiment which has just been described.

The masses may be made of a cheap material not having any particular properties; preferably, this material is steel since this metal is widely used in the cathode-ray tube industry.

When the frame tends to vibrate, it is advantageous for the surfaces of the masses and of the frame coming into contact with each other to be as large as possible in order to damp the said vibrations as quickly as possible. The parallelepipedal shape lends itself well to this use, it being possible for the masses to lie along the sides of the frame without being problematic in terms of overall size of the frame/mask assembly and without forming a screen for the electron beams passing inside the perimeter defined by the frame. However, the use of other shapes, in particular cylindrical masses, is not excluded, it being possible for the density of the material used to allow the volume of the masses to be decreased.

It may be useful to endow the damping means according to the invention with means for guiding the movements of the masses 51 so that the ends of the said masses do not strike the edges of the tube or intercept the electron beams; this is because, in the case for example of rectangular masses, these masses are free to rotate about the pin 52 and their ends may then either strike the glass skirt of the tube or intercept the electron beams in the space defined by the sides of the frame; these guiding means may, as illustrated in FIG. 5, comprise one or more lugs 56, secured to the frame, whose height compared to the surface of the frame is greater than the specific mechanical clearance between the masses 51 and the sides of the frame.

Figure 6:
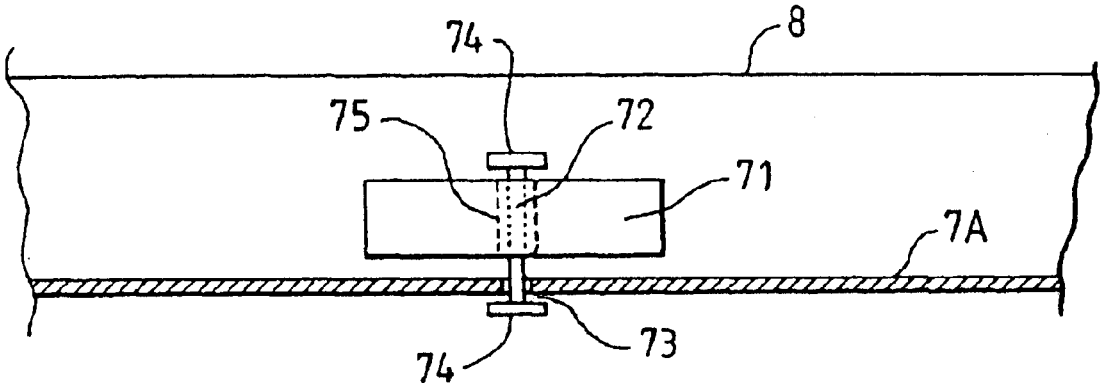

In the simplified embodiment, the damping device comprises a single mass 71 fastened to the side of the frame with some mechanical clearance by virtue of a pin 72. FIG. 6 shows partially from the side, the frame/mask assembly at the location where the damping device according to the invention is fastened. A channel 75 is made in the metal mass 71 so that it can be traversed by pins 72 substantially perpendicular to the side 7 of the frame. The pin 72 may, at one of its ends, be welded to the side 7 of the frame, and be terminated by a flared head 74 so as to retain the mass 71; the mass 71 then moves by sliding along the pin 72. In an alternative embodiment, the channel 75 for the mass 71 and the pin 72 have complimentary threads so that the pin can be screwed into the mass; the pin 72 passes through the side 7 of the frame by means of an orifice 73, the diameter of which is greater than the diameter of the said pin; on the side of the frame away from that where the mass 71 is found, the pin has a flared head intended to hold the damping device on the frame. This simple device is more suitable for small tubes where the mask is less sensitive to vibrations in the environment.

The devices described above are not limiting; it is also possible to place the damping means on the long sides of the tube, to place these means in the middle of a pair of parallel sides or to place these means in several locations on each side of the same pair.

What is claimed is:

1. Colour cathode-ray tube comprising:

a colour selection mask in the form of a metal sheet, adapted in order to be fastened to a substantially rectangular support frame and comprising one pair of short parallel sides and one pair of long parallel sides, the frame/mask assembly being placed inside the glass front face of the tube, means of damping vibrations of the frame/mask assembly, placed on each side of at least one pair of parallel sides of the frame, the damping means being characterized in that they comprise at least one mass connected to the side of the frame by a connection having a mechanical clearance between the facing surfaces of the mass and of the frame such that the frame can move independently of the mass for a distance corresponding to said mechanical clearance.

2. Cathode-ray tube according to the preceding claim, characterized in that the connection is provided by at least one substantially cylindrical metal pin, the said pin being mechanically connected to the frame and passing through the mass by means of a channel.

3. Cathode-ray tube according to claim 2, characterized in that the pin is screwed into the mass.

4. Cathode-ray tube according to claim 2, characterized in that the metal pin passes through the side of the frame by means of an orifice with a diameter greater than the diameter of the said pin.

5. Cathode-ray tube according to claim 2, characterized in that the damping means comprise guiding means in order to prevent the mass from rotating about the pin.

6. Cathode-ray tube according to claim 1, characterized in that the weight of the damping device placed on one side of the frame is at least equal to 60% of the weight of the said side.

7. Cathode-ray tube comprising:

a colour selection mask in the form of a metal sheet, adapted in order to be fastened to a substantially rectangular support frame and comprising one pair of short parallel sides and one pair of long parallel sides, the frame/mask assembly being placed inside the glass front face of the tube, means of damping vibrations of the frame/mask assembly, placed on each side of at least one pair of parallel sides of the frame, the damping means for each side of the pair of parallel sides comprise two identical masses placed on either side of each of the said sides;

the damping means being characterized in that they comprise at least one mass connected to the side of the frame by a connection having a mechanical clearance between the facing surfaces of the mass and of the frame.

8. Cathode-ray tube comprising;

a colour selection mask in the form of a metal sheet, adapted in order to be fastened to a substantially rectangular support frame and comprising one pair of short parallel sides and one pair of long parallel sides, the frame/mask assembly being placed inside the glass front face of the tube, means of damping vibrations of the frame/mask assembly, placed on each side of at least one pair of parallel sides of the frame, the damping means being characterized in that they comprise at least one mass having a parallelepipedal shape connected to the side of the frame by a connection having a mechanical clearance between the facing surfaces of the mass and of the frame.

* * * * *